United States Patent [19]

Hagedorn

[11] 3,946,809

[45] Mar. 30, 1976

[54] OIL RECOVERY BY COMBINATION STEAM STIMULATION AND ELECTRICAL HEATING

[75] Inventor: Alton R. Hagedorn, Houston, Tex.

[73] Assignee: Exxon Production Research Company, Houston, Tex.

[22] Filed: Dec. 19, 1974

[21] Appl. No.: 534,261

[52] U.S. Cl. ..... 166/248; 166/263; 166/272; 166/303

[51] Int. Cl.[2] ..... E21B 43/24

[58] Field of Search ..... 166/248, 303, 272, 263

[56] References Cited

UNITED STATES PATENTS

| | | | |
|---|---|---|---|
| 2,801,090 | 7/1957 | Hoyer et al. | 166/248 X |
| 3,103,975 | 9/1963 | Hanson | 166/248 X |
| 3,106,244 | 10/1963 | Parker | 166/248 |
| 3,259,186 | 7/1966 | Dietz | 166/263 |
| 3,434,544 | 3/1969 | Satter et al. | 166/303 |
| 3,547,192 | 12/1970 | Claridge et al. | 166/248 |
| 3,547,193 | 12/1970 | Gill | 166/248 |
| 3,605,888 | 9/1971 | Crowson et al. | 166/248 |
| 3,696,866 | 10/1972 | Dryden | 166/248 |
| 3,724,543 | 4/1973 | Bell et al. | 166/248 |
| 3,848,671 | 11/1974 | Kern | 166/248 |

*Primary Examiner*—Stephen J. Novosad
*Attorney, Agent, or Firm*—Lewis H. Eatherton; Gary D. Lawson

[57] ABSTRACT

Disclosed herein is a method for recovering oil from a subterranean oil-bearing formation in which adjacent wells are subjected to steam stimulation to create a zone around each well which is initially heated to approximately steam temperature and which has a high water saturation following steam injection and oil production. Subsequently, a fluid having a relatively high electrical conductivity, such as a brine solution, is injected into the heated zone around the wells. Preferably the injected volume of high conductivity fluid is sufficient to displace the steam condensate from the zone and to fill the zone with the high conductivity fluid. The wells are then completed as electrodes and current is passed through the formation to heat the oil which was not heated to any significant amount by the steam. Following one or more cycles of steam stimulation and electrical heating, additional oil is recovered from the formation, preferably by line-drive steam displacement or by pattern steam flooding.

11 Claims, 5 Drawing Figures

OIL RECOVERY BY COMBINATION STEAM STIMULATION AND ELECTRICAL HEATING

BACKGROUND OF THE INVENTION

1. Field of the Invention

This invention relates to the recovery of petroleum from a subterranean formation utilizing wells for injecting heated fluids into the formation, for passing electrical current through the formation, and for withdrawing petroleum from the formation.

2. Description of the Prior Art

Among the more promising methods that have been suggested or tried for the recovery of oil from viscous oil reservoirs are those which introduce thermal energy into the reservoirs. The viscosity of the oil in these reservoirs is generally so high that the oil cannot be recovered at economical rates using conventional techniques. However, the viscosity of these oils can generally be radically reduced by heating. Consequently, when thermal energy is introduced into these reservoirs and the oil is heated, the viscosity will generally be reduced to a point that the oil can be made to flow at efficient and economical rates.

The thermal energy may be in a variety of forms. Hot water flooding, in situ combustion, electric heating, and steam injection are examples of methods using thermal energy that have been used to recover oil from these viscous oil reservoirs. Each of these thermal methods can be useful under certain circumstances. However, hot water flooding and in situ combustion are not widely used in recovering highly viscous oils. In such applications both methods have proven to be deficient in certain respects. Also, as will be discussed later in more detail, electrical and steam heating have been found to have undesirable drawbacks under certain circumstances.

Steam flooding, also known as steam displacement or steam drive, has been used successfully to recover low and medium viscosity crude oils from subterranean formations. In this process, steam is continuously injected into a pattern of injection wells to displace oil to interspersed producing wells. Application of this process to formations containing highly viscous crude oils, however, often requires unachievable pressure gradients or extremely close, uneconomical well spacing. It is desirable, therefore, to preheat the formation by some means prior to the initiation of a steam flood and thereby reduce the oil viscosity to a level that will permit displacement with reasonable pressure gradients and well spacings.

One method for preheating the formation involves cyclic steam stimulation of all wells in a pattern for several years. Heat transfer by conduction and convection causes the heated volume around each well to increase with successive cycles until heat connection between the wells is achieved. Subsequently, the steam stimulation pattern can be converted to a steam drive process with steam being injected into one row of injection wells and oil withdrawn from a row of offset producing wells. Advantages of this method include relative simplicity and significant oil production during the preheating phase. A major shortcoming of this method is that the rate of advance of the heat front decreases significantly as the heated area increases. Also in reservoirs containing highly viscous crudes, it may be necessary to inject steam at pressures in excess of the parting or fracturing pressure for the formation to provide a path for steam entry. This will cause the heated area to assume an elliptical configuration with the major axis oriented in the direction of the parting or fracturing trend for the area. Heat transfer normal to this preferred flow trend may be quite slow and hence it might be quite difficult to heat the area between adjacent wells in a direction normal to this preferred flow trend.

Efforts to overcome this problem have included preliminary injection of a relatively small volume of steam at a pressure which is less than the formation breakdown pressure. Subsequently a second and larger volume of steam is injected into the formation at a pressure greater than the formation breakdown pressure. The first injection step creates a heated zone which is substantially cylindrical. The second injection step generally creates a fracture or pressure parting of the formation which is highly conductive to injected fluids. As a consequence, the heated region around the injection well is larger and it remains approximately cylindrical (U.S. Pat. No. 3,739,852, Woods et al.). While this method is promising, it does not overcome the problem of large areas of unheated oil existing between adjacent rows or producers. Hence, subsequent steam flooding may not be successful.

A second proposed method for preheating a formatioon involves completing wells as electrodes and passing a current through the formation thus increasing the temperature through resistive heating (U.S. Pat. No. 2,801,090 Hoyer et al.). The principal advantage of this method is that electrical current can flow where fluid flow is difficult or impossible. Although this method shows promise, it suffers from some disadvantages. There is no significant oil production during the preheating phase which is unfavorable from an economic standpoint. Also, geometric effects result in very high current densities near the electrode well which results in excessive power losses and temperatures near the well. These very high current densities occur near the well since the well is, in effect, a relatively small-diameter electrode compared to the size of the reservoir being heated. Temperatures near the electrode very rapidly reach steam temperature for the existing reservoir pressure and this causes the connate water within the reservoir to begin to vaporize. The resultant gas saturation causes a drastic increase in formation resistivity since the conductive flow path for electrical current — connate water — is removed and this effectively blocks further power input into the formation. Thus, after a short time, the oil in the regions between electrode wells cannot be effectively heated.

SUMMARY OF THE INVENTION

In the practice of this invention, the major disadvantages of the prior art methods for recovering oil from subterranean formations utilizing thermal energy are overcome. The wells within the formation are first subjected to cyclic steam stimulation. Preferably, steam stimulation is continued until there is an interconnection of the steam heated zones between wells aligned in rows parallel to the preferred flow trend. Following oil and water production at the termination of cyclic steam stimulation, a conductive fluid is injected into the wells. Preferably, the conductive fluid will be a saline water having an electrical resistivity which is lower than the resistivity of the formation or connate water. In the preferred embodiment, the volume of saline water will be sufficient to displace substantially all of the water from the heated region of the formation surrounding the well. Following the injection of the electrically conductive fluid, the wells are completed as electrodes and current is passed between the wells or rows of wells to increase the temperature of the oil in the reservoir which was not heated by the cyclic steam injection. Power losses in the previously heated formation surrounding each well are reduced because the high temperature and increased saturation of high salinity water both serve to reduce formation resistivity. Power losses and the consequent transfer of thermal energy are thus concentrated in the unheated portion of the reservoir. Also, the high conductivity regions serve as large area electrodes which reduce current density and temperatures near the electrode wells. After the formation has been preheated sufficiently to allow mobilization of the formation oil with reasonable pressure gradients, the wells would be converted from electrode wells to injection and producing wells. Finally, a conventional pattern steam flood would be initiated to increase oil recovery.

DESCRIPTION OF THE PREFERRED EMBODIMENT

Prior to discussing the practice of the method of this invention it will perhaps be helpful to first discuss a typical well installation for the introduction of thermal energy into the formation. This well installation illustrates an adaptation of the well for passing electrical current from the surface to the subterranean formation. However, as will be understood by one of ordinary skill in the art, this installation is easily modified for the injection of steam into the formation and production of heated fluids from the formation.

Figure 1:
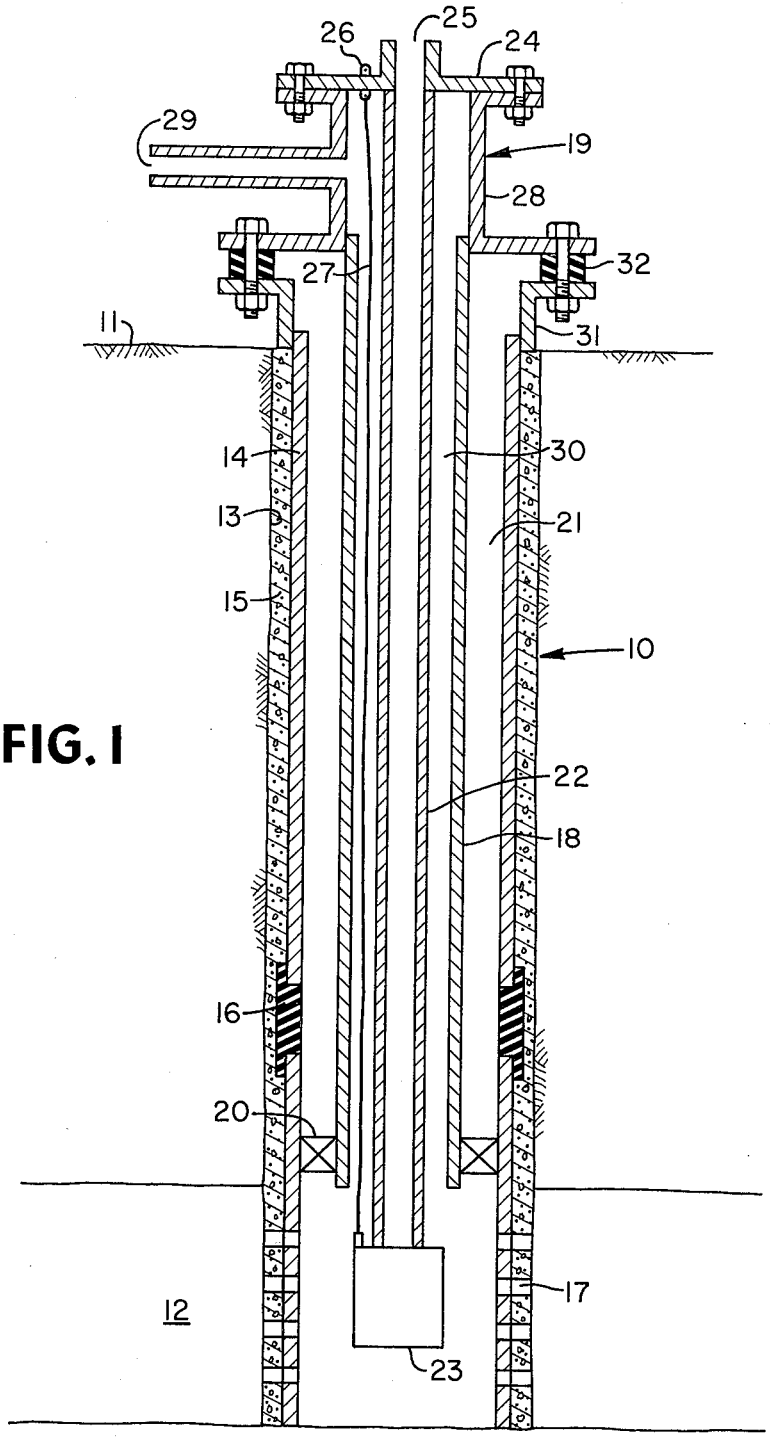
FIG. 1 is a schematic elevation view in partial section showing a typical well installation for use in the practice of this invention.

Referring now to FIG. 1, as well shown generally at 10, passes from the surface of the earth 11 to a subterranean oil-bearing formation 12. The wellbore 13 is lined with a suitable length of steel pipe or casing 14 and bonded in place by cement sheath 15. As an example, the casing may be 5½inch OD with standard threads and couplings. The bottommost portion of casing 14 is electrically insulated from the uppermost portion of the casing by one or more annular insulators 16 and has perforations 17 which permit the flow of fluids between the formation 12 and the interior of the casing 14.

A string of tubing 18 (for example, 3½inch OD) extends from the wellhead 19 to approximately the oil-bearing formation 12. Tubing 18 may be maintained separate from casing 14 by means of insulating spacers in annulus 21. Tubing 18 is set on a packer 20 to provide a sealed annulus 21 which may be filled with oil or other fluid of low electrical conductivity to retard the flow of electrical current across this annular space. Concentrically disposed within tubing string 18 is a second tubing string 22 (for example, 1¼inch OD) bearing a suitable electrode 23 at its lowermost end. Tubing string 22 extends from a point approximately adjacent the oil-bearing formation 12 to a flange member 24 on wellhead 19. Flange member 24 has an opening 25 which permits the circulating of brine down tubing 22 and up annulus 30 to cool electrode 23 and to provide electrical connection between electrode 23 and formation 12.

Flange member 24 also contains connector means 26 to provide electrical interconnection with power cable 27 extending from connector means 26 to electrode 23. Alternatively, power can be supplied to electrode 23 by means of tubing 22. Flange 24 is suitably bolted to spool flange 28 which is provided with an opening 29 for the passage of fluids between the surface and formation 12 by means of tubing-tubing annulus 30. Spool flange 28 is bolted to bottom flange 31 and is electrically insulated from flange 31 by means of insulating spacers 32.

During the steam stimulation cycle or cycles and subsequent production of heated fluids, a well installation such as that shown in FIG. 1 or other suitable well installations for use in the injection or production of heated fluids may be used. When the well installation shown in FIG. 1 is employed for this purpose, tubing string 22 will normally be removed from the well along with electrode 23 and power cable 27 and thermal insulation may be applied to outer tubing member 18. Normally, during such thermal operations the tubing-casing annulus 21 will be evacuated of oil.

The cyclic steam stimulation process is a technique designed to increase oil productivity by heating the formation near each well to decrease the viscosity of the oil in the formation so as to permit more efficient use of natural formation energy. In the application of this technique to the practice of this invention, a heated fluid, such as steam, is injected through opening 29 in spool flange 28, down the interior of tubing string 18, through perforations 17, and into formation 12. Generally, the steam is injected at the highest practical rate for periods ranging from 10 to 60 days, depending on specific reservoir conditions.

After the injection of the initial volume of steam, it will generally be preferred to shut the well in and permit the formation to "heat soak" for a period of two days to a week. During this heat soaking period, thermal energy is transferred from the condensing steam to the rock matrix and to the formation fluids, including oil. The heating of the oil reduces its viscosity and makes it more susceptible to flow.

Preferably the well is then open to production and formation fluids including the heated oil are withdrawn by means of tubing string 18. The production phase of the cycle may last from several months to more than a year depending on factors such as the volume of steam injected and well productivity. Such steam stimulation cycles will be repeated on the well until the rate of heat front advance and oil production reach unacceptably low values.

Figure 2:
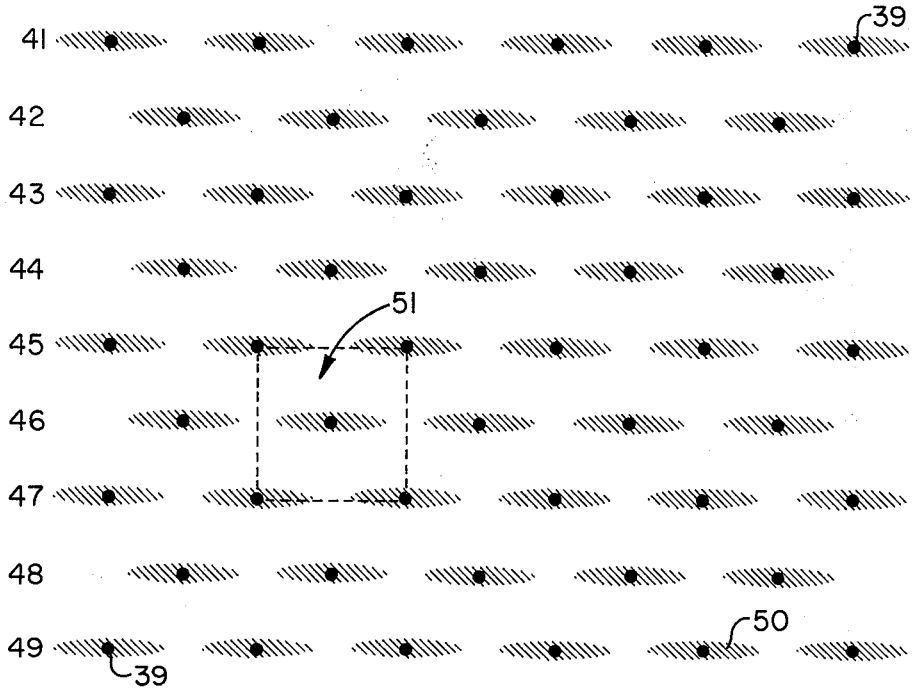
FIG. 2 is a plan view of an array of wells in an oil-bearing subterranean formation which shows the steam-heated portions of the formation around each well.

FIG. 2 illustrates the condition existing in a typical reservoir after it has been subjected to cyclic steam stimulation. In this instance, the reservoir is completed with wells 39 aligned in parallel rows 41–49. The wells in alternate rows, for example row 46, are spaced midway between the wells on adjacent rows 45 and 47. As can be seen in FIG. 2, there is an area 50 surrounding each well which has been subjected to steam stimulation which has been initially heated to approximately the temperature of saturated steam at reservoir pressure and which has a high water saturation resulting from production of oil and condensation of the injected steam. The area of the reservoir which lies beyond the heated zones is substantially at the original reservoir temperature and water saturation. It will also be noted from FIG. 2 that the steam heated areas 50 are substantially elliptical. Very often the steam heated areas will have a preferred orientation due to geologic forces imposed on the formation or to directional permeability characteristics of the formation. This preferred orientation is referred to as the preferred flow or fracture trend and, in the case shown in FIG. 2, this trend is parallel to the rows of wells.

This trend can be used to advantage in another aspect of this invention. Where the well rows (vertical, horizontal or diagonal) are parallel to the trend or where the rows are drilled parallel to a known trend, the heated areas surrounding the wells can be made to interconnect. This interconnection can provide a more efficient distribution of heat in the reservoir as will be discussed in more detail later and can be accomplished by continuing the steam stimulation cycles until interconnection occurs or by fracturing each well to create a zone of high fluid conductivity between wells.

FIG. 2 also illustrates one convenient basic well pattern for use in practicing this invention and in analyzing the performance of the operation. This basic well pattern 51 is a so-called five-spot pattern and comprises four corner wells and one center well. This type of pattern will be referred to in the discussion of the electric heating phase of this invention.

One last observation should be made with reference to FIG. 2. Following steam stimulation the steam heated areas 50 will be highly saturated with water from the condensed steam. This water is substantially distilled with a very low content of salt or other ionic substances and hence is a very poor electrical conductor.

During the next stage, the condensed steam is displaced from the wellbore by injecting a fluid having a higher electrical conductivity than the formation water. Generally, an aqueous solution of sodium chloride at a concentration, for example, of 10 weight percent will be injected into the heated portion of the reservoir to provide good electrical conductivity in the heated regions surrounding the well. As an alternative, a relatively high concentration of ionic solute may be entrained in the steam injected during the injection phase of the last stimulation cycle. Generally, this will not be preferred, however, due to the fact that during the subsequent production phase in the cycle, the electrical conductivity of this material may be reduced by dilution with connate water.

Preferably, the volume of high conductivity fluid should be sufficient to displace substantially all of the water condensed from the steam from the heated area. The volume should not be so great, however, as to displace substantial amounts of high-electrical-resistivity connate water from the unheated portion of the reservoir. Although these volumes cannot be determined exactly, they can be closely approximated by one of ordinary skill in the art utilizing the general principles of fluid flow and reservoir engineering.

After placement of the highly conductive saline solution into the formation, the wells are then completed as electrodes and alternating current is passed between wells through the highly conductive fluid placed in the formation and the naturally occurring connate water. Power losses in the previously heated formation surrounding each well are reduced because the high temperature and increased saturation of highly saline water both serve to reduce formation resistivity. Power losses are thus concentrated in the unheated portion of the reservoir. Distribution of heating is improved because geometrical effects are reduced, i.e. the heated volume containing highly conductive water serves as a large electrode. The larger electrode results in reduced current densities at the edge of the steam heated volume which in turn results in lower temperature levels. This circumvents one of the major problems in the prior art techniques of electric heating — the problem of very high current densities occurring near the relatively small diameter electrode. As has been previously stated, this rapidly causes the connate water near the wellbore to flash to steam giving a drastic reduction in formation resistivity near the wellbore, blocking power input into the formation, and dissipating a large amount of input energy in the near vicinity of the wellbore. In contrast, in the practice of this invention the electrical energy is converted to thermal energy in the area of high oil saturation, i.e. the unheated regions of the reservoir containing unheated formation oil.

Generally, it will be preferred to employ alternating current rather than direct current in the practice of this invention. Direct current may cause corrosion of the electrodes and may cause the evolution of gases at the electrodes which will reduce current flow at that point.

After the formation has been preheated sufficiently to allow mobilization of the oil which was unheated by the steam, the wells are converted from electrode wells to steam injection and production wells and a conventional pattern steam flood would be initiated to increase oil recovery.

The invention of this application can perhaps be more clearly understood with reference to the following examples:

EXAMPLE I

This Example I and the following examples illustrate the application of this invention to a reservoir having the following characteristics:

| | |
|---|---|
| Thickness | 105 feet |
| Porosity | 30 percent |
| Connate water saturation | 45 percent pore volume |
| Salinity of connate water | 1 weight percent sodium chloride |
| Original reservoir temp. | 55°F. |
| Reservoir pressure | 450 psi |

At the initiation of the process the wells are subjected to cyclic steam stimulation process. For example, at a given well, steam at 600°F and having a 70% steam quality is injected into a well over a period of 38.2 days. The volume of steam injected has a mass equal to that of 25,250 barrels of water at standard temperature and pressure. The well is then shut in for a period of two days to one week to permit the injected steam to condense and transfer its latent heat of condensation to the formation rock and fluids. The well is then placed on production and 23,327 barrels of fluid (oil, water and steam) are withdrawn from the formation over a period of 90 days at which time the production rate has declined to an unacceptably low level. The foregoing steps in the steam stimulation cycle are repeated until the oil recovery per cycle reaches its economic limit.

At the termination of the steam stimulation cycle or cycles, a heated area surrounds each well in the pattern. In this example, this heated area in the formation is originally at substantially steam temperature of the existing reservoir pressure, has a water saturation of approximately 75% with very low salinity, and is elliptical in horizontal configuration having minor axis of approximately 33 feet and a major axis of 180 feet.

A high conductivity fluid is then injected into the heated region of the reservoir. In this instance the high conductivity fluid is an aqueous solution containing 10 weight percent sodium chloride and is injected at a temperature of 250°F. The injection period for this brine solution is approximately 15 days. Following this step, the heated region in the reservoir surrounding the well has a water saturation of 75% having a salinity of approximately 10 weight percent NaCl. Beyond this region, the water saturation decreases sharply to the original connate water saturation of 45% with a salinity equivalent to one weight percent sodium chloride.

During the electrical heating phase the wells are completed as shown in FIG. 1 with a 10 acre, five-spot being a completion unit. The circuitry at the surface can be arranged in any conventional manner, for example as shown in FIG. 1 of U.S. Pat. No. 2,801,090.

Figure 3:
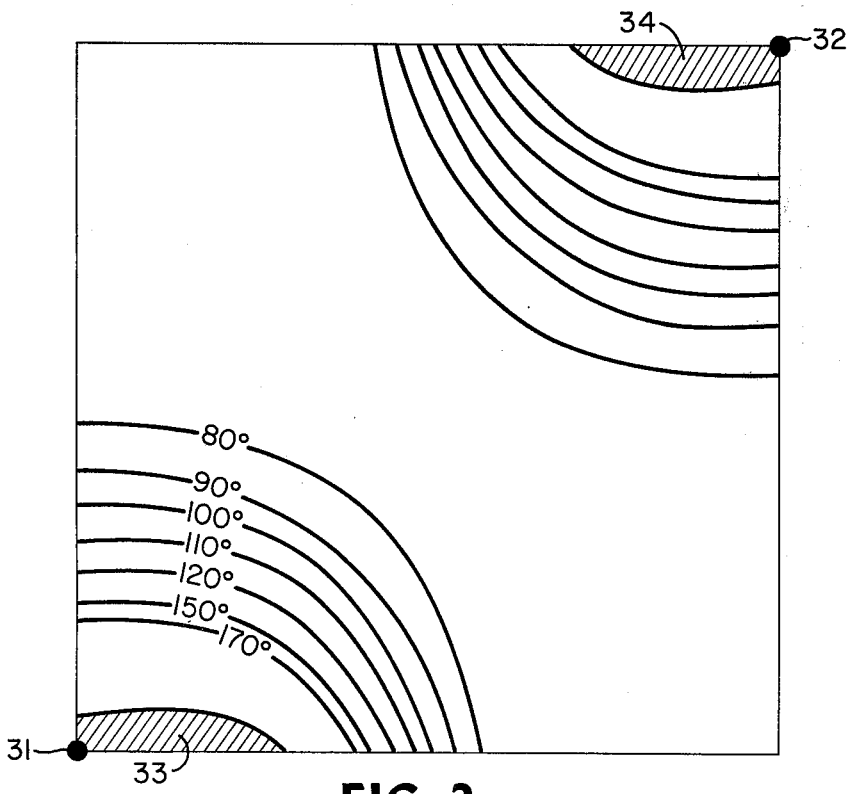
FIG. 3 is a plan view of one-fourth of a five-spot well pattern which shows the temperature distribution in the formation after heating the formation with one megawatt of power for one year.

FIG. 3 shows the temperature distribution within the formation after a period of heating by electrical energy. FIG. 3 illustrates onefourth of the basic 10 acre, five-spot with the center well 31 and one of the corner wells 32. Surrounding wells 31 and 32 are zones of high electrical conductivity 33 and 34 respectively. FIG. 3 shows the temperature distribution at the horizontal center of the formation after one year of electrical heating with one megawatt of power. The temperature at wells 31 and 32 is approximately 390°F which is substantially below steam temperature (456°F) at the reservoir pressure — approximately 450 psi. It can be noted from FIG. 3 the reservoir has been heated to at least 80°F over approximately one-half of its areal extent.

Figure 4:
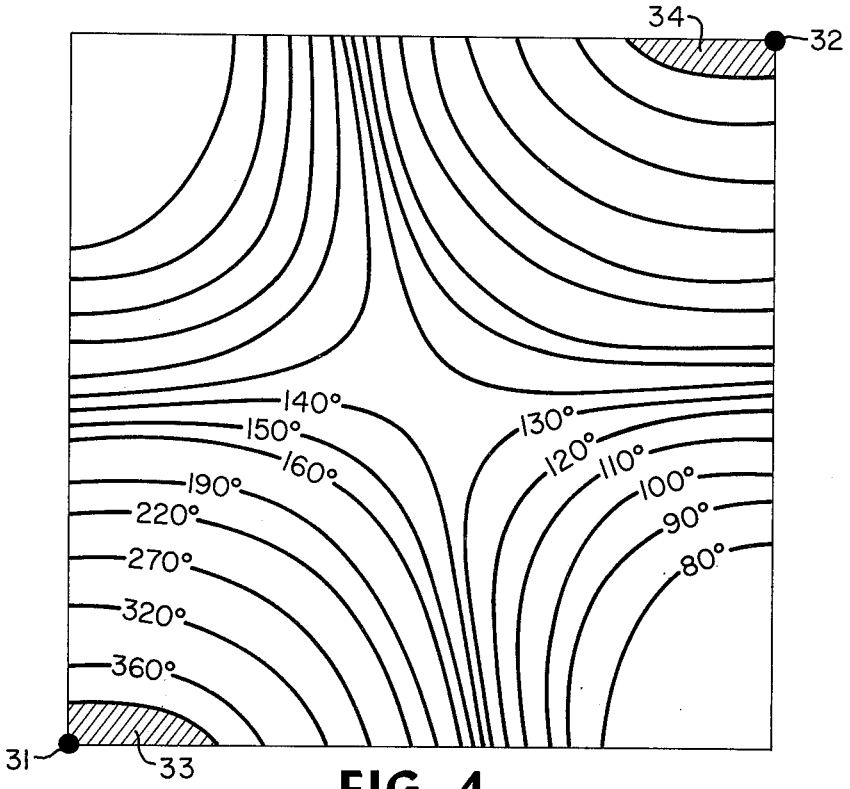
FIG. 4 shows the temperature distribution in the pattern illustrated in FIG. 3 after three years of electrical heating.

FIG. 4 shows the thermal distribution within the formation area illustrated in FIG. 3 after three years of electrical heating with one megawatt of power. As can be seen a substantial portion of the reservoir has been heated to a temperature in excess of 120°F. For the particular crude existing in this formation, the viscosity of the oil at 120°F is sufficiently low that the oil can be displaced by steam without inordinate pressure drops. It should also be noted that the temperature at wells 31 and 32 following this period of electrical heating is only 412°F — still substantially below steam temperature at formation pressure.

After the reservoir has been electrically heated to the temperature distribution shown in FIG. 4 a conventional steam flood is initiated. The corner wells of each five-spot are converted to steam injection wells and the center well of the five-spot is converted to a producing well. This results in a pattern flood in a single five-spot or in a well-known staggered, line-drive flood in repeated five-spots. The steam flooding would continue until the produced oil/water ratio reaches a predetermined economic limit.

EXAMPLE II

Example II illustrates another embodiment of this invention. In this embodiment the steam stimulation cycles discussed in Example I are continued until the steam heated region surrounding a well connects with the steam heated region surrounding an adjacent well in the same row along the preferred flow trend. Alternatively, the wells may be fractured to create a path for fluid flow between wells. Subsequent to steam injection and/or fracturing, the high conductivity fluid is injected into the wells to create a flow path for current along the lines of the wells. The wells are then completed as electrodes in the manner previously described and power is supplied to the formation for heating.

Figure 5:
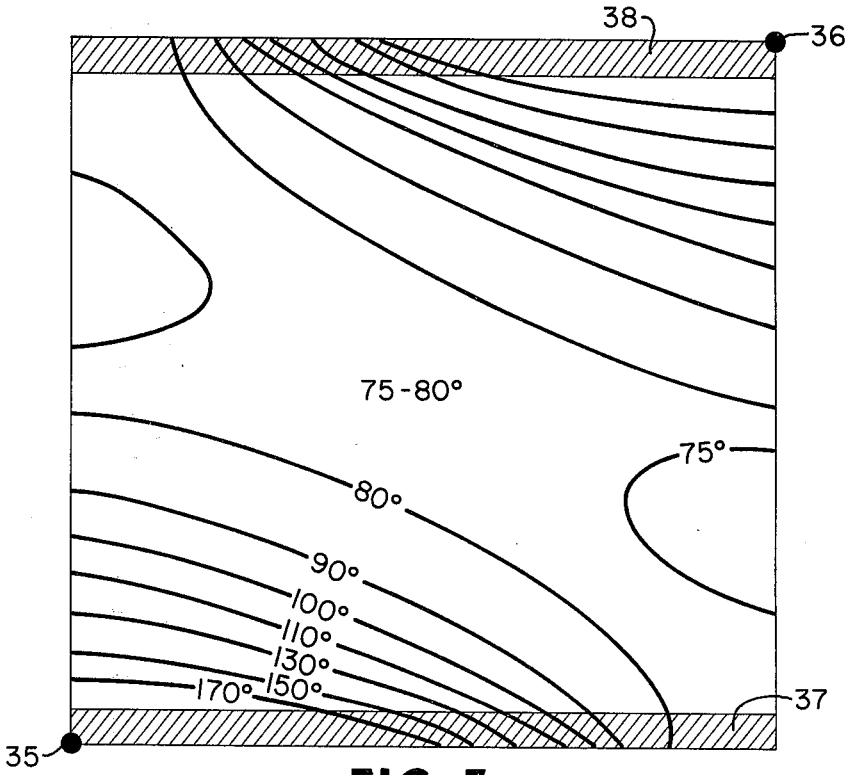
FIG. 5 is a plan view of one-fourth of a five-spot well pattern which shows the temperature distribution in the formation after the steam-heated zones around adjacent wells along a preferred flow trend have interconnected and after heating the formation with one megawatt of power for one year.

FIG. 5 illustrates the condition obtained in the reservoir shown in FIG. 3 subsequent to one year of electric heating with one megawatt of power. Center well 35 and corner well 36 are completed as electrodes as previously described. The zones of high electrical conductivity for these wells are shown at 37 and 38 respectively.

As can be seen with reference to FIG. 5 this embodiment gives improved distribution of heat within the formation. After approximately one year of heating nearly two-thirds of the formation has been heated to a temperature of 80°F or higher. The temperature at wells 35 and 36 is only 375°F — still well below steam temperature at the formation pressure. When the temperature in the center of the quadrant shown in FIG. 4 has reached a level where the formation oil can be mobilized by steam flood, electrical heating will be discontinued and steam flood initiated as previously described.

The principle of the invention and the best mode in which it is contemplated to apply that principle have been described. It is to be understood that the foregoing is illustrative only and that other means and techniques can be employed without departing from the true scope of the invention defined in the following claims.

What is claimed is:

1. A method for recovering oil from a subterranean formation containing oil and connate water and penetrated by a plurality of wells which comprises injecting steam into said formation at each of said wells to heat said formation and said oil contained in said formation, withdrawing heated oil from said formation by means of the same said wells and thereby decreasing the oil saturation in the steam heated portion of said formation and increasing the water saturation within said heated portion of said formation, injecting an electrically conductive fluid into said formation at a volume sufficient to occupy at least a part of the portion of the formation heated by said steam, passing an electrical current between said wells to further heat said formation and said oil contained in said formation, and withdrawing oil from said formation.

2. A method as defined in claim 1 further comprising, subsequent to passing an electrical current between said wells, injecting steam at one of said wells to drive heated oil toward a second of said wells and withdrawing heated oil from said formation by means of said second well.

3. A method as defined in claim 2 further comprising repeating the steps of injecting steam into said formation at each of said wells, withdrawing oil from said formation by means of the same said wells, injecting an electrically conductive fluid into said formation, and passing an electrical current between said wells prior to injecting steam at one of said wells to drive heated oil toward a second of said wells and withdrawing heated oil from said formation by means of said second well.

4. A method as defined in claim 1 wherein the electrically conductive fluid is a brine having a higher electrical conductivity than the connate formation water.

5. A method as defined in claim 4 wherein said brine is heated at the surface prior to injection into said formation.

6. A method as defined in claim 1 wherein the volume of electrically conductive fluid injected into the formation is sufficient to occupy substantially all of the water saturated portion of the steam heated portion of the formation.

7. A method as defined in claim 1 wherein steam is injected concurrently into each of said wells to heat said formation and oil contained in said formation.

8. A method as defined in claim 1 wherein steam is injected into said formation until the steam heated portion of the formation at one well interconnects with the steam heated portion of the formation at a second well.

9. A method as defined in claim 1 wherein each of said wells is fractured prior to injecting an electrically conductive fluid into said formation.

10. A method as defined in claim 1 wherein the electric current is passed between said wells by completing said wells as electrodes and applying alternating current between said wells.

11. A method as defined in claim 1 wherein, during the passage of electrical current between said wells, brine is circulated down each of said wells to cool said wells and to provide electrical contact between said wells and said formation.

* * * * *